US010597180B2

(12) United States Patent
Cassoli et al.

(10) Patent No.: US 10,597,180 B2
(45) Date of Patent: Mar. 24, 2020

(54) PACKAGING MACHINE WITH A HORIZONTAL-AXIS CAROUSEL, PARTICULARLY FOR PACKAGING ROLLS OF PAPER OR PACKS OF PAPER SERVIETTES OR OTHER SOLID PRODUCTS OF VARIABLE SIZE

(71) Applicant: CPS Company S.r.l., Calasecchio di Reno, Province of Bologna (IT)

(72) Inventors: Stefano Cassoli, Casalecchio di Reno (IT); Marco Cassoli, Casalecchio di Reno (IT); Paolo Cassoli, Casalecchio di Reno (IT)

(73) Assignee: CPS Company S.r.l., Casalecchi o di Reno (IT)

( * ) Notice: Subject to any disclaimer, the term of this patent is extended or adjusted under 35 U.S.C. 154(b) by 390 days.

(21) Appl. No.: 15/518,913

(22) PCT Filed: Oct. 27, 2015

(86) PCT No.: PCT/IB2015/058272
§ 371 (c)(1),
(2) Date: Apr. 13, 2017

(87) PCT Pub. No.: WO2016/067195
PCT Pub. Date: May 6, 2016

(65) Prior Publication Data

US 2017/0225810 A1 Aug. 10, 2017

(30) Foreign Application Priority Data

Oct. 31, 2014 (IT) ..... BO2014A0606

(51) Int. Cl.
*B65B 11/32* (2006.01)
*B65B 25/14* (2006.01)
(Continued)

(52) U.S. Cl.
CPC ..... *B65B 11/32* (2013.01); *B65B 25/146* (2013.01); *B65B 59/00* (2013.01); *B65B 11/28* (2013.01)

(58) Field of Classification Search
CPC ..... B65B 25/14; B65B 25/145; B65B 25/146; B65B 43/50; B65B 11/28; B65B 11/32
(Continued)

(56) References Cited

U.S. PATENT DOCUMENTS 4,509,310 A * 4/1985 Focke ..... B65B 11/58 53/170
4,790,115 A * 12/1988 Focke ..... B65B 11/28 198/473.1

(Continued)

FOREIGN PATENT DOCUMENTS

EP 0 165 204 12/1985
EP 0 888 968 1/1999

(Continued)

OTHER PUBLICATIONS

International Search Report for International Application No. PCT/IB2015/058272, dated Feb. 4, 2016, 5 pages.

(Continued)

*Primary Examiner* — Sameh Tawfik
*Assistant Examiner* — Valentin Neacsu
(74) *Attorney, Agent, or Firm* — Stetina Brunda Garred and Brucker

(57) ABSTRACT

A packaging machine with a carousel with horizontal axes, particularly suitable for packaging rolls of paper or packs of paper serviettes or other solid products of variable size, of the type that comprises a plurality of identical seats on the same carousel, angularly equidistant from each other, radially open towards both the outside and the inside and each (Continued)

formed by a longitudinal wall fastened perpendicularly to said carousel and by a parallel and opposite wall, the distance of which from said fixed longitudinal wall can be adjusted to ensure that, with a movement parallel to the axis of the carousel, a product of variable size with its wrapping sheet can be inserted between these walls, and wherein the same seats comprise, between said longitudinal walls, two transverse walls designed to cooperate with the ends of said product with the wrapping sheet inserted in the same seats, which for this must have an adjustable reciprocal distance, whereby at least one of these transverse walls is connected to means for adjusting the distance from the other transverse wall, characterized in that said adjustment means comprise, for each said wall, respective internal threads and respective slides sliding on respective rectilinear guide means, directly or indirectly supported by the table of the carousel and parallel to the movement of the associated walls, with two sets of screws being provided parallel to these guide means that cooperate with said internal threads, which are also rotationally supported, directly or indirectly, by said table, these screws being kinematically connected to each other by associated means to ensure that by acting on one of the components of these connection means, the adjustment of the dimensions in length and in width of all the seats is performed in a centralized, rapid and precise manner to adapt them to the different sizes of the products to be packaged.

10 Claims, 7 Drawing Sheets

(51) Int. Cl.
*B65B 59/00* (2006.01)
*B65B 11/28* (2006.01)

(58) Field of Classification Search
USPC ..... 53/234, 466
See application file for complete search history.

(56) References Cited

U.S. PATENT DOCUMENTS

| | | | | | |
|---|---|---|---|---|---|
| 4,909,020 | A * | 3/1990 | Focke | B65B 11/32 | 53/202 |
| 5,775,063 | A * | 7/1998 | Ikai | B65B 51/14 | 53/133.8 |
| 6,067,780 | A * | 5/2000 | Gentili | B65B 11/22 | 53/230 |
| 6,098,371 | A * | 8/2000 | Cassoli | B65B 25/146 | 53/201 |
| 8,568,080 | B2 * | 10/2013 | Paganini | B65G 57/32 | 198/418.4 |
| 2002/0116895 | A1 * | 8/2002 | Antoniazzi | B65B 11/22 | 53/230 |
| 2009/0025337 | A1 * | 1/2009 | Skarin | B65B 61/186 | 53/133.1 |
| 2010/0107559 | A1 * | 5/2010 | Schroeder | B65B 7/20 | 53/367 |
| 2014/0033657 | A1 * | 2/2014 | Cere' | B65B 11/00 | 53/461 |

FOREIGN PATENT DOCUMENTS

| | | |
|---|---|---|
| GB | 527 982 | 10/1940 |
| JP | 2003 128005 | 5/2003 |

OTHER PUBLICATIONS

Written Opinion of the International Searching Authority for International Application No. PCT/IB2015/058272, dated Feb. 4, 2016, 7 pages.

* cited by examiner

PACKAGING MACHINE WITH A HORIZONTAL-AXIS CAROUSEL, PARTICULARLY FOR PACKAGING ROLLS OF PAPER OR PACKS OF PAPER SERVIETTES OR OTHER SOLID PRODUCTS OF VARIABLE SIZE

CROSS-REFERENCE TO RELATED APPLICATIONS

The present application claims priority to PCT International Application No. PCT/IB2015/058272 filed on Oct. 27, 2015, which application claims priority to Italian Patent Application No. BO2014A000606 filed Oct. 31, 2014, the entirety of the disclosures of which are expressly incorporated herein by reference.

STATEMENT RE: FEDERALLY SPONSORED RESEARCH/DEVELOPMENT

Not Applicable.

BACKGROUND

The invention concerns a packaging machine with a horizontal-axis carousel, which falls within International Classification B65B11/28, particularly suitable for packaging rolls of paper, or stacks or packs of paper serviettes, or other solid products of variable size, the machine being equipped for this purpose with means to enable rapid and simplified adjustment of the dimensions of the seats of the carousel, to adapt them to the variable sizes of the products to be packaged.

It should be noted that in the definition of the seat of the carousel, the term 'longitudinal walls' will be use to referred to the walls opposite to each other and parallel to the axis of the carousel, designed to support the product laterally and the distance between which varies with the diameter or height of the product, while the term 'transverse walls' will be use to referred to those perpendicular to the axis of the carousel, usually positioned between said longitudinal walls, designed to cooperate with the ends of the product and the distance between which varies with the length of the product.

Patent EP 165.204 is cited as known state of the art. This patent describes a carousel provided with seats with one of the longitudinal walls fixed and the other oscillating on an axis parallel to that of the carousel and therefore easily adaptable to products of variable width, and provided with opposite transverse walls, of which the certain ones, are supported by a secondary carousel internally facing the main one and mounted on a shaft coaxial with and inside that of the main carousel and which can be made to slide axially upon command, while the outer transverse walls are supported by telescopic arms that longitudinally carry a pinion mechanism with two opposed racks. One of these racks is integral at the end of said telescopic arm with the outer transverse wall, while the other rack is connected to said secondary carousel. To reduce the distance between said two transverse walls of the seats, it is necessary to axially move the secondary carousel away from the main one for the inner transverse wall to approach the outer one, which is automatically moved towards the inner transverse wall by said rack and pinion mechanism, with an equal and self-centring displacement. In this solution, the machine's zero reference is constituted by the transverse centre-line plane of the seats of the carousel, with respect to which the centre line of the reel from which the packaging material is unwound must be kept longitudinally aligned, and so the support means of the reel must also be equipped with systems for the self-centring positioning of the reel.

Packaging machines are also known of the type described, for example, in British Patent GB 527 982, in which the transverse walls of the seats that are internal and close to the carousel are kept fixed, while as the length of the product to be packaged varies, the distance between said inner transverse walls and the outside ones is varied, the latter being associated with common support means for this purpose, for example a secondary carousel, such that by modifying its axial distance from the main carousel that supports the longitudinal walls and the fixed, inner transverse ones of the seats, it is possible to adapt the internal dimensions of the seats to the changes in length of the products to be packaged. In this last case, the machine's zero reference is constituted by said inner transverse walls of the seats, with respect to which the side of the reel of packaging material facing the main carousel is kept fixed.

The publications of patent applications JP 2003/128005 A and EP 0 888 968 A are also cited as known state of the art.

All of the known solutions considered above have strengths and weaknesses, but all have drawbacks of limited accessibility to the seats from the inside and from the other side of the main carousel, are constructively complex and do not have seats than can be adjusted in a simple, rapid, precise and centralized manner, nor modular characteristics that, as well as rendering production of the machine more economic, allow them to be easily set up for clockwise or anticlockwise rotation of the carousel, with product unloading to the right or to the left of the carousel, according to the user's lay-out requirements.

BRIEF SUMMARY

The invention intends to overcome the limits of the known art with a horizontal-axis carousel packer, particularly for packaging rolls or packs or stacks of paper serviettes or other products of variable size, the characteristics and advantages of which will become clear from the following description of a preferred embodiment, shown by way of non-limitative example in the figures of the seven accompanying sheets of drawings.

DETAILED DESCRIPTION

Figure 1:
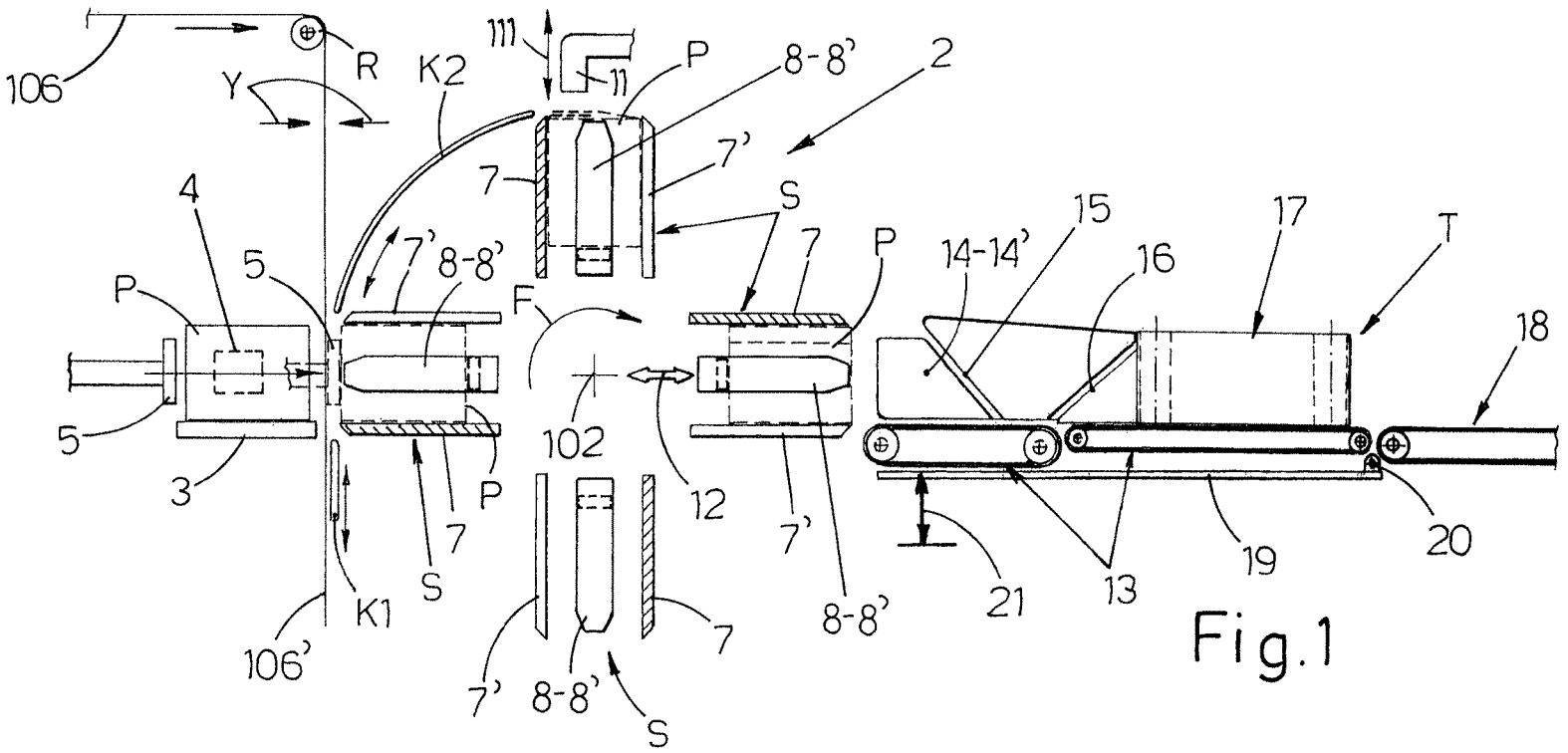
FIGS. 1 and 2 schematically show the machine, seen in front elevation and in plan, respectively, in the version with clockwise carousel rotation, for loading the product from the left and unloading the packaged product on the right.
Figure 2:
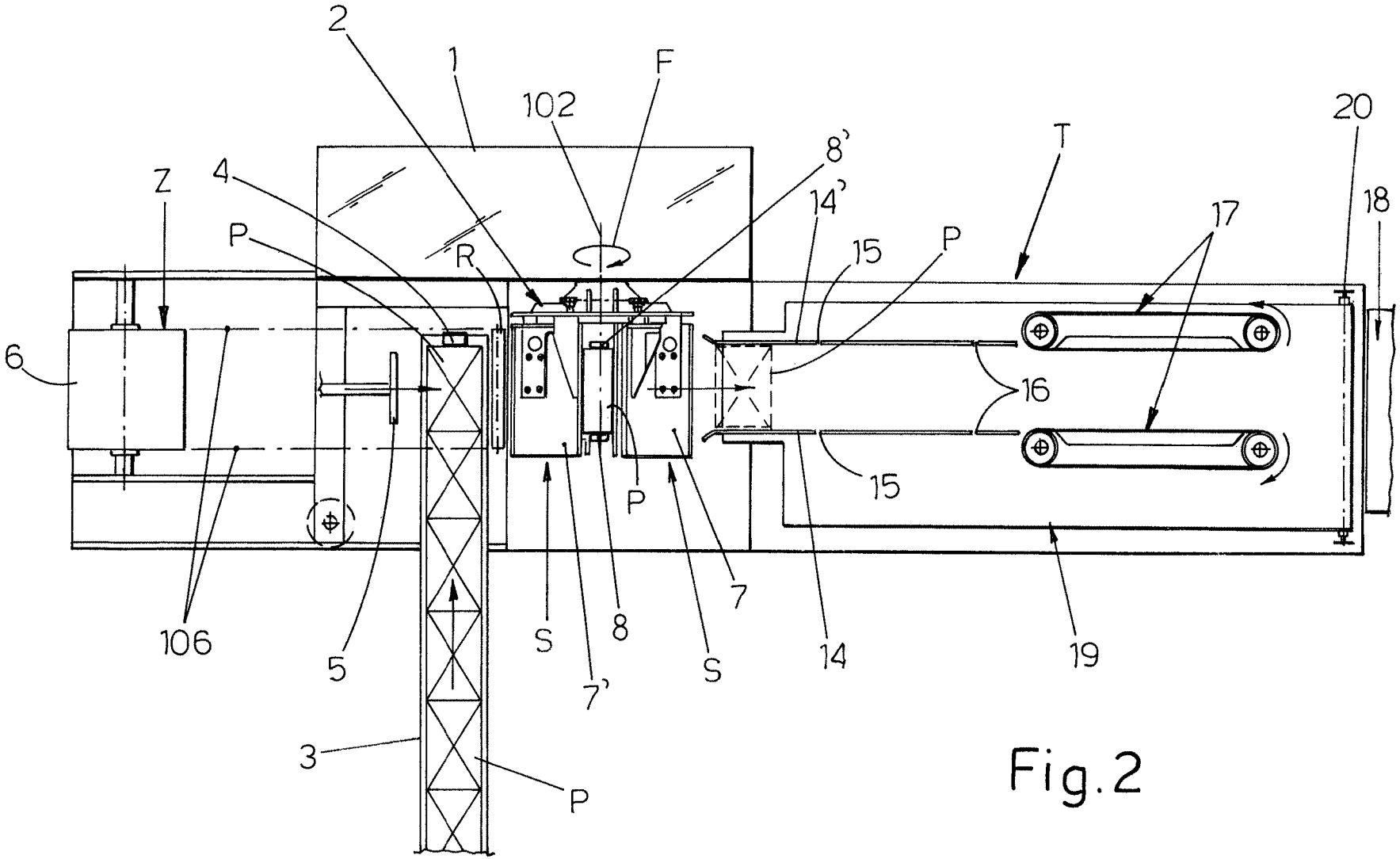
Figure 3:
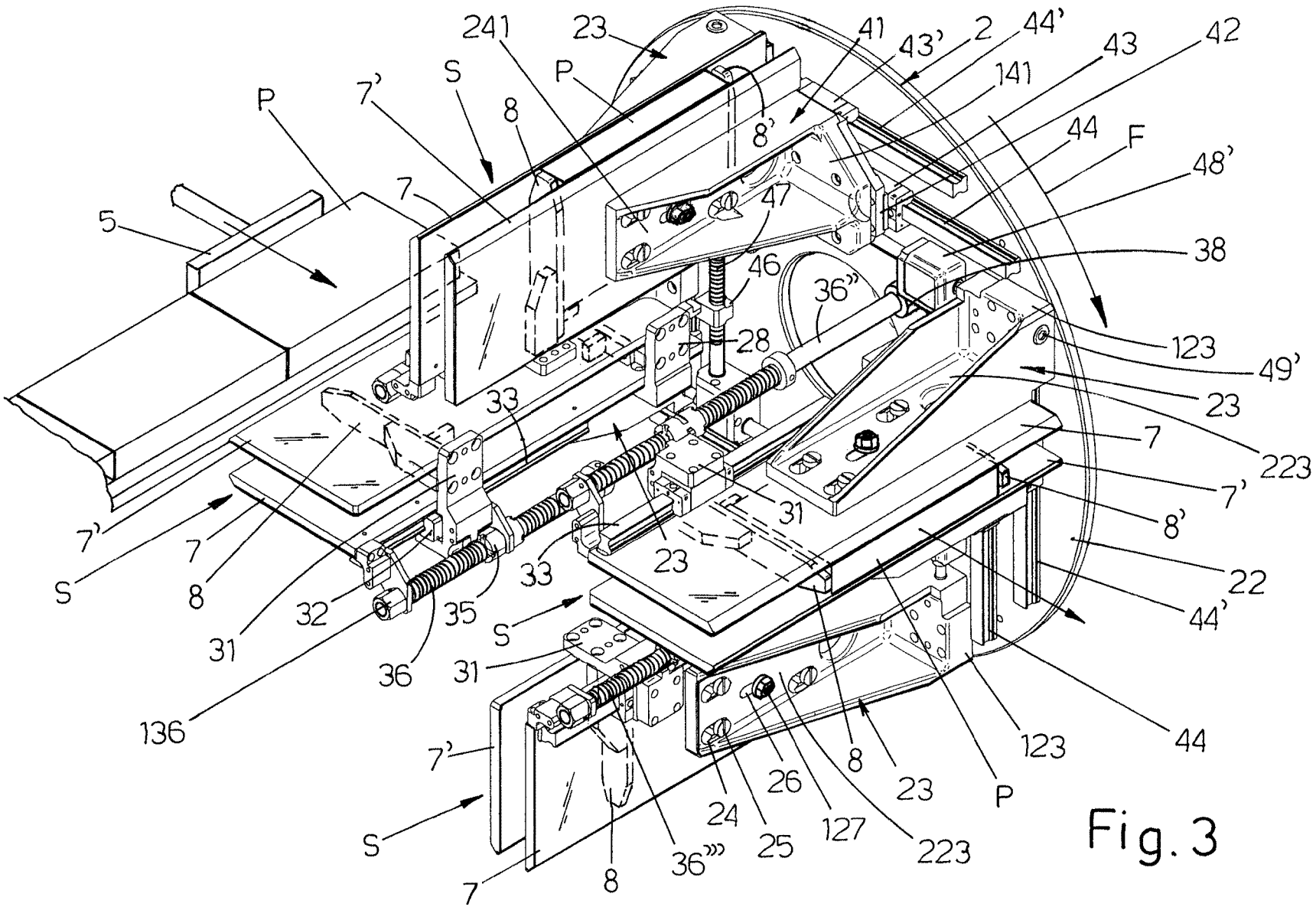
FIG. 3 shows the carousel of the machine in the preceding figures, from a front perspective seen from the seat from which the packaged product is unloaded.

From FIGS. 1 and 2 it can be noted that the packaging machine comprises a box-shaped base structure 1, of mainly vertical extension, which on one side supports a cantilever-mounted carousel 2 with the possibility of intermittently rotating in the desired direction, in this case in the clockwise direction indicated by the arrow F. The carousel 2 has a horizontal axis 102, perpendicular to the vertical extension of the base 1 and receives the necessary rotation from an index drive and/or other suitable known means of intermittent drive capable of operating at high working speeds and housed in the base 1. The product P to be packaged, for example in the form of rolls of paper or stacks of paper serviettes, is fed to the left side of the carousel 2 by a conveyor 3 on which the products P travel in a single file (see below) parallel to the axis 102 of the carousel, so that the product at the head of the queue can be stopped against an end stop 4, in a correct and predetermined position with respect to the carousel 2, such that this product at the head of the queue can be inserted at the right moment by a known side pusher 5 onto the seat S of the carousel that is waiting on the left of the carousel 2 and which is at a suitable height to receive the product P. If the product P is constituted by rolls of paper, these are positioned with their axes parallel to the direction of travel of the conveyor 3. Alternatively to that described above, conveyor 3 could be of the bucket type, which advances the products separated from one-another and has feed-pitch operation, with the front wall of the seats forming and replacing said end stop 4.

The reel 6 of flexible packaging material, usually a heat-sealable film of width related to the length of the products P, is arranged to the left of the conveyor 3 with its axis parallel to that of the carousel 2. The reel 6 has its left side Z is in a fixed position closely correlated to that of end stop 4 or equivalent feed means of the product P and the table of the carousel 2, which, taken together, form the 'zero' reference of the packaging machine. The film 106 unwound from the reel 6 is conveyed, by known means schematically indicated by R in FIG. 1, along a downward path between the product at the head of the conveyor 3 and the seat S of the carousel 2 horizontally aligned with it, such that as the product is inserted into the seat S, the same product P is laterally wrapped, for 180° (FIG. 8), by a length 106' of the film 106, which is separated from the film upstream by known cutting means Y.

Figure 8:
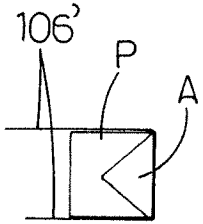

From FIGS. 1 and 2, it can be noted that the seats S are each formed by a pair of longitudinal walls 7, 7' that cooperate with opposite lateral portions of the product P and comprise two transverse walls 8, 8' that cooperate with the opposite ends of the product P. It follows that when a product P is inserted by the pusher 5 into the seat S aligned with it, leading portions A of the sheet 106' are folded over on the ends of the product P, as schematically shown in FIG. 8, due to interference of the sheet 106' with the transverse walls 8, 8' of the seat.

Figure 14:
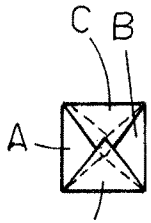
FIGS. 8, 9, 10, 11, 12, 13 and 14 are schematic head-on views of the product during successive steps of the packaging cycle performed by the carousel machine according to the invention in the version with product loading from the left and unloading on the right of the carousel.
Figure 13:
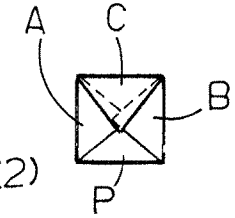
Figure 12:
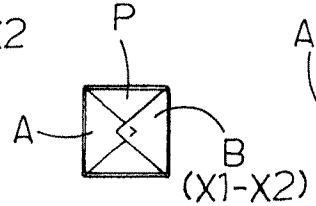
Figure 11:
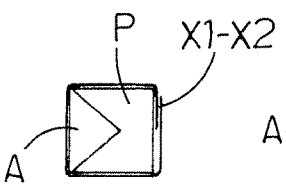
Figure 10:
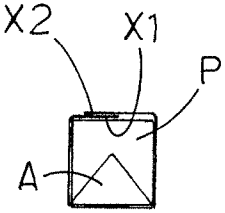
Figure 9:
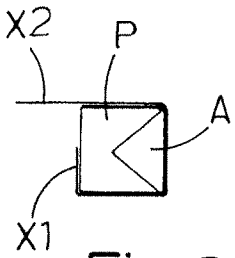

From FIGS. 1 and 2, it can be noted that the carousel 2 according to the invention is equipped, for example (see below), with four angularly equidistant seats S and is activated with cyclic rotations, for example, of ninety degrees in the clockwise direction F, so that two seats S are cyclically in opposite horizontal positions, one in the already considered left-hand position for loading the product and the other in the opposite right-hand position for unloading the already partially wrapped product, as detailed below. After each ninety degree rotation, a seat S passes from the left-hand position corresponding to the nine o'clock position, to the raised position corresponding to the twelve o'clock position, while another seat S passes from the unloading position corresponding to the three o'clock position, to the low position corresponding to the six o'clock position. While a seat S is in the nine o'clock position and while it passes to the twelve o'clock position, known types of folders K1 and K2 first raise side flap X1 of the wrapping 106', as in FIG. 9, and then lower the side flap X2 of the wrapping 106' so that when the seat S with the product reaches the upper station at twelve o'clock, the product with the wrapping sheet is in the position schematized in FIG. 10, with flaps X1 and X2 of the wrapping reciprocally overlapping, facing upwards and in a suitable position for being reciprocally sealed by a known means of longitudinal heat sealing 11, which is lowered and then raised at the right moment, as indicated by the double-headed arrow 111. Then, when the seat passes from the upper station to the right-hand horizontal one, the one corresponding to the three o'clock position, the product with the wrapping are arranged as in the diagram in FIG. 11, with sealed flaps X1 X2 of the wrapping on the right and with folded flap A of the wrapping on the left. In this station, located in the three o'clock position, a known type of pusher 12 that operates inside the carousel is operated at the right moment to expel the product with the wrapping from the seat S and transfer it to a known type of final transfer and conditioning apparatus T equipped with its own lower-level transfer means 13 that, with its own fixed and lateral folders 14, 14', folds the front flaps B of the wrapping over the ends of the product P, as in FIG. 12, and then, with its own inclined paths first descending 15 and then ascending 16, folds the top end flaps C and then the bottom ones D of the wrapping over the ends of the product P, as in the sequence from FIGS. 13 and 14, and which finally, using its own pair of lateral, synchronized and heated conveyors 17, performs reciprocal pressure heat sealing on the flaps of wrapping A, B, C and D, folded and reciprocally overlapping on opposite ends of the product P. The packaged product is then collected and removed by a conveyor 18. Obviously, the apparatus T first considered is equipped with known means for ensuring that as the length of the product to be packaged changes, it is possible to adjust the distance between the parallel operational components of the apparatus T, keeping the components closest to the side with the base 1 of the machine and which are aligned with the zero line Z of the machine fixed (see below).

Since the height of the feed conveyor 3 should preferably remain unchanged, to simplify adjustment of the size of the seats S as the size of the product P to be packaged varies, provision has been made such that walls 7 of the seats are fixed and walls 7' are adjustable in their distance from walls 7, so that when wall 7 of a seat laterally reaches conveyor 3, it is always aligned to be coplanar with the active surface of the conveyor, whatever the size of the products P to be packaged. Since the discharge conveyor 18 of packaged products must also preferably remain with a fixed height position as the size of the products varies and because the seats S reach the corresponding station at the three o'clock position, with the lower wall 7' varying its height as the size of the product changes, provision has been made that the longitudinal structure 19 of the final folding and sealing device T is mounted with the possibility of oscillating its end next to the discharge conveyor 18 about a transverse axis 20 and is connected to raising and lowering means 21, controllable manually or in a semi-automatic or automatic manner, to be able to align the active surface of the transfer means 13 of the apparatus T each time to be coplanar with wall 7' of the seat S in the unloading step.

For the above reasons regarding the zero reference Z of the machine, as the length of the products P varies, the position of the transverse walls 8' of the seats S, those closest to the platform of the carousel 2, does not change, while it must be possible to adjust the distance of these from the opposite transverse walls 8.

In the description that follows, it is illustrated how by acting on two different points of any of the four seats S of the carousel, located in a convenient position for the operator, it is possible to perform said adjustments of the distance between walls 7, 7' and between walls 8, 8' of all the seats S of the carousel 2 in a centralized, rapid and precise manner to adapt them to the variations in size of the products P.

In FIGS. 3 to 6, reference numeral 22 indicates the platform or table of the carousel 2, which is fitted by means of the spoked rear structure 122 onto the axially rotating shaft 222 connected to the intermittent rotation means M located in the base structure 1 in FIG. 2. The fixed walls 7 of the seats S are supported on the outer face by the leg of respective brackets 23 fixed to the table 22 by their foot 123 and which, on their same ribbed leg parallel to the carousel's axis of rotation, carry longitudinal slots 24 engaged by the heads of screws 25 fastened to wall 7 and carry a longitudinal slot 26 through which a stud 27 perpendicularly fastened to wall 7 passes and on which a lock nut 127 can be fastened. When the seats S of the carousel are set up for feeding the product from the left-hand side of the carousel, as in the example in FIGS. 3 and 5, the screws 25 and said lock nut 127 are positioned on the ends of the associated slots 24 and 26 that are closest to the carousel 2. The function of the slots 24 and 26 will be explained further on in the description.

A small bracket 28, fastened with screws to the outer face of the wall 7 that is closest to the carousel's axis, which is parallel to axis 102 and not far from the table 22 of the carousel 2, projects towards the inner space of the seat S and carries, on the protruding part, a perpendicularly fastened appendage 29 that enters the seat S and which supports the fixed inner transverse wall 8' of the seat S, provided with an internal projection 108' to correctly halt the product P inserted into the seat S. The transverse wall 8 of the seat S, the distance of which from said fixed transverse wall 8' must be adjustable as the length of the product P varies, and which is also provided with an internal projection 108 aligned with internal projection 108' for correctly halting the product P inserted into the seat S, is fixed on the appendage 30 of a small bracket 31 next to previously mentioned bracket 28, but which unlike the latter carries a slide 32 on its foot that is parallel to the axis 102 of the carousel 2 and which slides on a small rectilinear guide 33 fastened with screws on the outer face of the fixed wall 7 of the seat S. Bracket 31 carries a short appendage 34, fixed laterally and extending towards the carousel's axis, which supports an internal thread 35 cooperating with a screw 36, also parallel to the axis 102 of the carousel and rotationally supported at one end by a support 37 fastened on the neutral zone of the end facing wall 7, where the screw 36 has a head 136 for rotation, while the other end of the same screw 36 passes through a bushing 38 supported, for example, by the carousel table 22 or by another component described further on, and emerges at the back of the table 22 with a segment on which a pinion 39 is fitted. It is clear from FIG. 5 how, by connecting the pinions 39, 39', 39" and 39'" of the four screws 36, 36', 36" and 36'" of the four seats S of the carousel together with a chain 40 that circumscribes all four of said pinions and that is also positioned on the rear face of the table 22, where it is kept in tension by suitable means (not shown), it is possible to perform adjustment of the distance of the movable transverse wall 8 from the fixed one 8' of all the seats S of the carousel by acting on just one of the heads 136 of the adjustment screws 36, the one in the most accessible and convenient position for the operator. By turning one of the screws 36, 36', 36" and 36'" in the clockwise or anticlockwise direction, all four screws 36, 36', 36" and 36'" of the four seats S turn simultaneously in the clockwise or anticlockwise direction and shift the movable transverse walls 8 of all the seats S of the carousel by the same amount and in the same direction, forwards or backwards. It is understood that it is possible to use equivalent means, such as toothed pulleys and toothed belts, or other known means useful for the purpose, instead of said pinions 39-39'" and said chain 40.

It is understood that the scope of the invention also covers the implementational variant whereby the screws 36, 36', 36" and 36'" can each be equipped with two segments having reverse threads, one of which is reserved for the movement of transverse walls 8, while the other can be assigned to the self-centring movement of transverse wall 8' should this also be made movable with internal thread and guide/slide means similar to those serving said movable transverse wall 8. In this case, it is clear that as the length of the products P changes, the position of the end stop 4 (indicated in FIGS. 1 and 2) must be adjusted and that both the packaging film feed means 106 and the final unit T for completing and sealing of the ends of the product's packaging must be provided with self-centring adjustment means.

Figure 4:
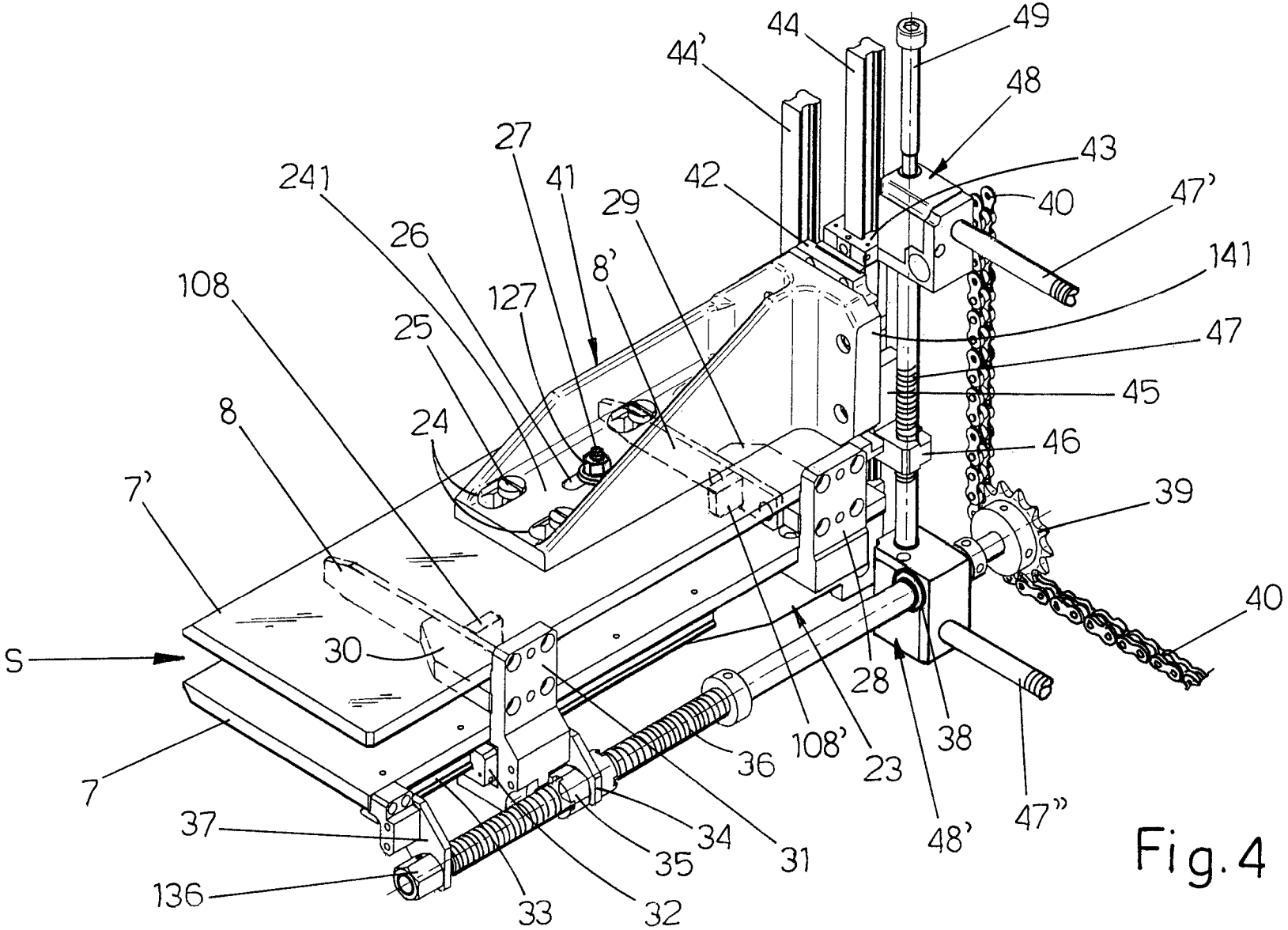
FIG. 4 shows, from a lateral-internal perspective, one of the modular seats of the carousel, in particular the seat that is shown in FIG. 3 in the phase of loading a product.
Figure 5:
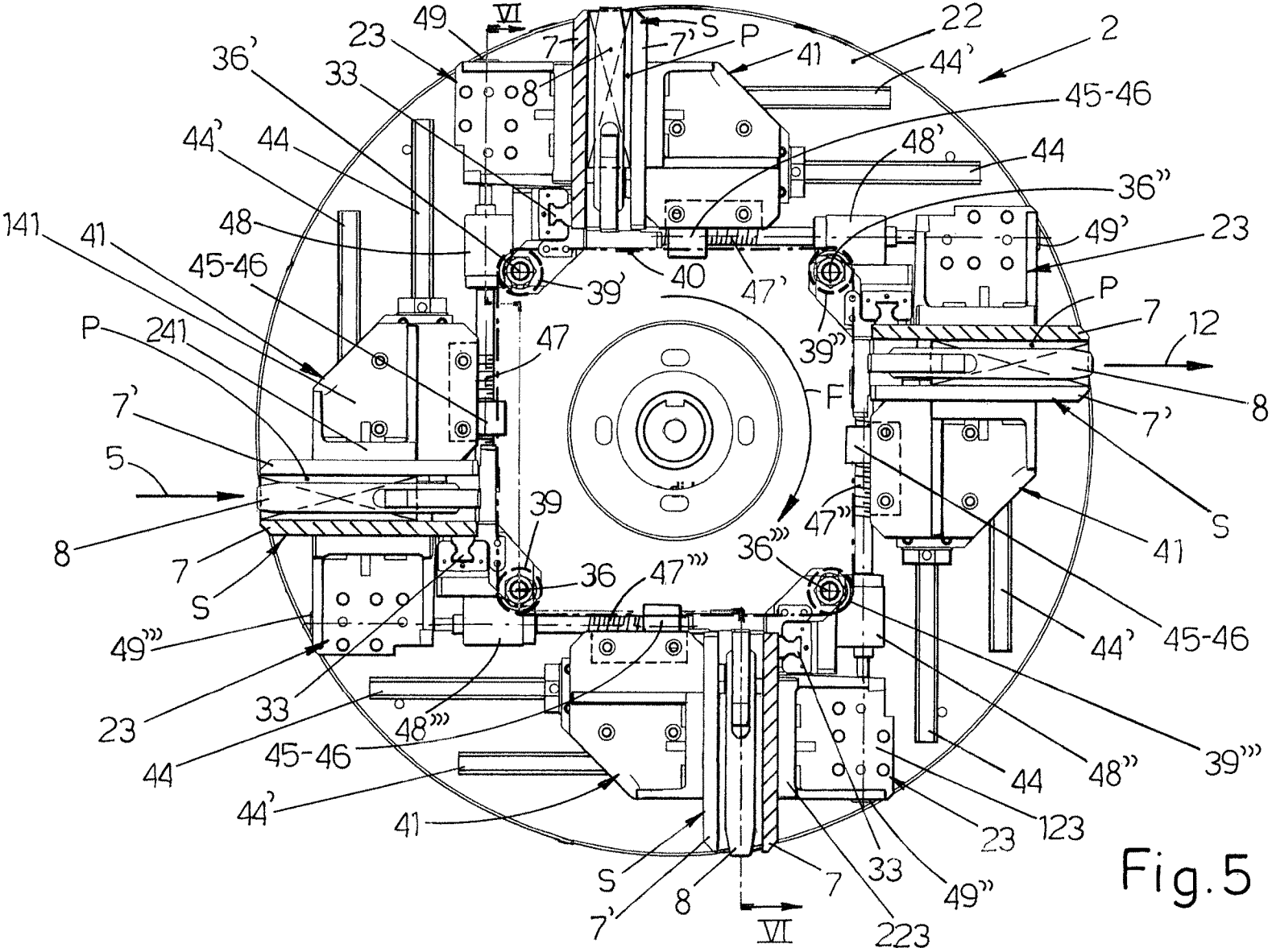
FIG. 5 shows the head-on front elevation of the carousel in the preceding figures.
Figure 6:
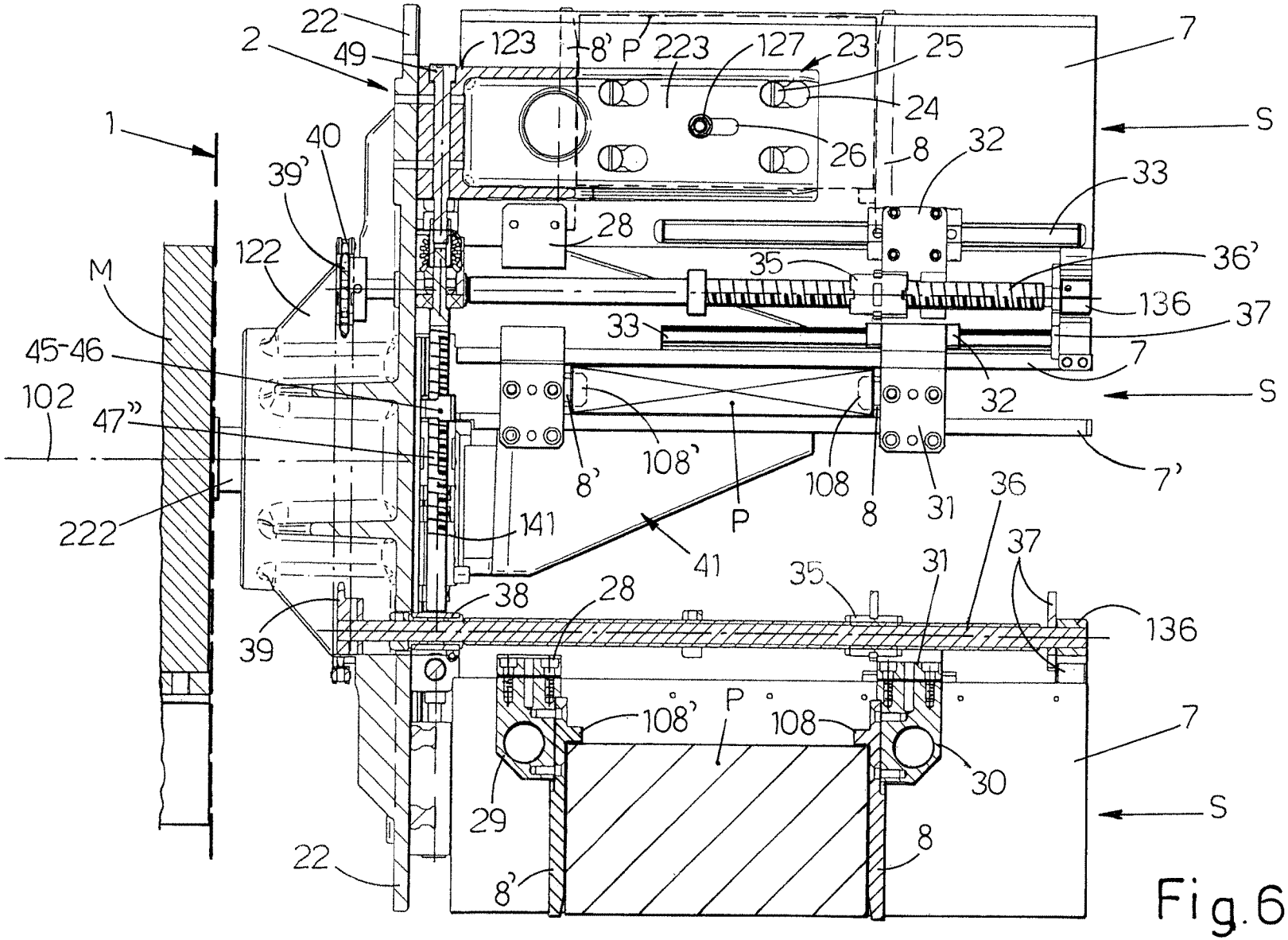
FIG. 6 shows other details of the carousel in FIG. 5 sectioned along line VI-VI.

It can be noted in FIGS. 3 to 6 that the movable longitudinal walls 7' of the seats are fastened, with the same means 24-27 and 127 previously described for the fixed wall 7, to the ribbed leg 241 of a respective bracket 41, the foot 141 of which is fixed to a plate 42, in turn fastened on a pair of slides 43, 43' that are parallel to each other, perpendicular to wall 7' and slide on respective rectilinear guides 44, 44' fastened on the table 22 of the carousel 2. A body 45 is fastened on the foot of each bracket 41 and projects from the inner side of the foot, with a portion that carries an internal thread 46 parallel to said guides 44, 44' and which cooperates with a screw 47 that, as shown in the details of FIGS. 4 and 5 in particular, is rotationally supported at the ends by a pair of transfer units or boxes 48, 48' with bevel gearing, with 90° drive transfer output, which, with further screws 47', 47" identical to screws 47, are connected to another two transfer boxes with bevel gearing 48" and 48'" connected to each other by a further screw 47'" identical to the previous ones, these transfer boxes 48-48' being placed in the corners of an ideal square having its centre on the axis 102 of the carousel 2, being fastened on the table 22 of the carousel and being arranged to support the previously mentioned bushings 38 for screws 36, 36', 36" and 36", these also arranged in the corners of an ideal square having its centre on the axis 102 of the carousel 2.

The transfer boxes 48, 48', 48", 48'" are placed on the inner side of the foot 123 of each fixed bracket 23 that carries the fixed longitudinal wall 7 of each of the four seats S, this foot 123 also carrying a rotatably mounted control rod 49 that has an outwardly pointing head, with a recessed hexagonal shape for example, and is connected to a drive output of the respective bevel gearbox 48, 48', 48", 48", all so that by acting on any head of the four control rods 49, 49', 49", 49'" that is in the most convenient position for the operator, the operator can simultaneously and rapidly adjust the distance between the movable wall 7' and the associated fixed longitudinal wall 7 of all four seats S of the carousel 2 with precision and by the same amount.

By observing the various drawings in FIGS. 3 to 6, it can be appreciated how all four seats S of the carousel and the associated adjustment means are perfectly identical to each other, are modular in nature and can therefore be manufactured with low costs.

Figure 7:
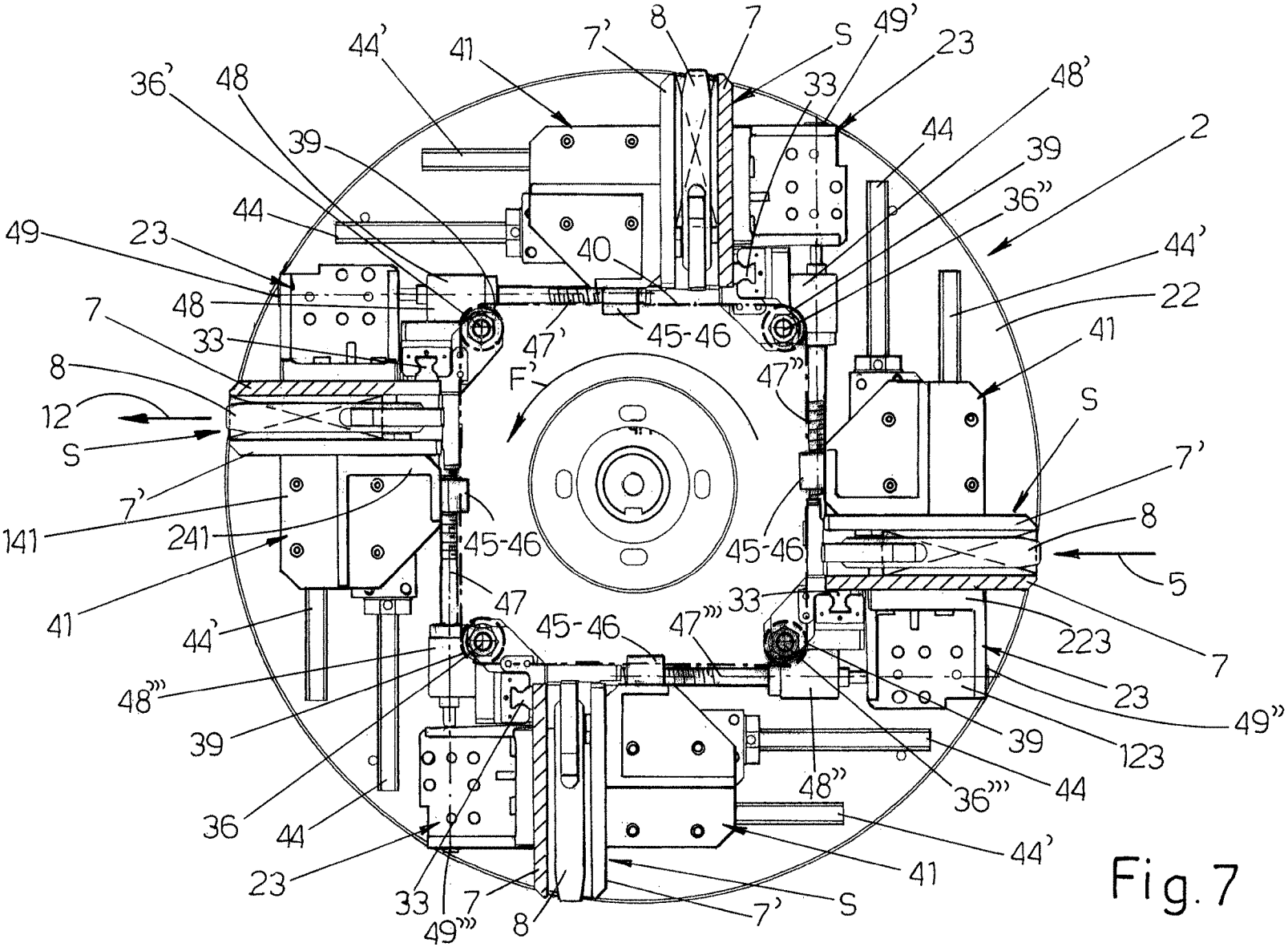
FIG. 7 is a head-on front view of the carousel, in the anticlockwise-rotation version, with product loading from the right and unloading of the packaged product on the left.

As mentioned at the beginning of this description, one of the objects of the invention is to ensure that the carousel can be set up for loading from the left, with unloading on the right, or, having the carousel always pointing with its face with the seats S in the same direction in space, ensure that the same carousel can be set up for loading from the right and unloading on the left, as shown in FIG. 7, and not only when the machine is manufactured, but at any time during the life of the machine. While it is possible to achieve an almost similar result with the current state of the art by rotating the machine by 180° about a vertical axis, but with the problem of having to then reverse the origin of the products on the feed line 3, or, by maintaining the direction of origin of the product, of having to modify the position of the end stop 4 when the length of the product changes, with the carousel machine according to the invention, when the machine is first installed, or at any other time during the life of the machine, it is possible to set it up for feeding from the left, as in FIGS. 1 to 6, or for feeding from the right, as in FIG. 7, without having to change anything on the discharge unit T and the feed line 3. To achieve these objectives, cyclic rotation means have been used for the carousel 2, which can turn the carousel clockwise F as in FIG. 5 or anticlockwise F' as in FIG. 7. The table 22 of the carousel 2 is provided with four threaded holes to carry the pairs of guides 44, 44' and the fixed brackets 23, with the different set-ups in FIGS. 5 and 7, while the fixed longitudinal walls 7 and the movable ones 7' of the seats S are set up to be able to rotate 180° about a transverse axis. To facilitate this correct and different assembly on the associated brackets, the slots 24 and 26 first mentioned with reference to FIG. 4 come in useful, as for the solution in FIG. 7, provision will be made for the screws 25 and 27, 127 to be on the opposite end of said slots, the one furthest away from the carousel. The fixed walls 7 will be provided with additional holes to support guide 33 and support 37 with a different layout. The movable bracket 41 will also be provided with additional holes on its foot to support the body 45 with the internal thread 46 in opposite positions. The placement of the first kinematic chain 39-39' and 40 and the second kinematic chain 47-47', 48-48', 49-49' does not change as they are concentric with the axis 102 of rotation of the carousel 2.

It is understood that carousel machines with a number of seats other than four and that use the innovative solutions set forth herein also fall within the scope of the invention. Finally, it is understood that the description refers to a preferred embodiment of the invention, to which numerous variants and constructional changes may be applied, all without departing from the guiding principle of the invention, as described, illustrated and hereinafter claimed.

The invention claimed is:

1. A packaging machine for packaging rolls of paper or packs of paper serviettes, the machine comprising:

a carousel having a plurality of identical seats rotating around a horizontal axis and a table perpendicular to said axis, said seats being angularly equidistant from each other around the axis and radially open towards both an inside and an outside of the carousel, each seat formed by:

a fixed longitudinal wall fastened perpendicularly to said table;

an adjustable longitudinal wall arranged parallel to, and at a first distance from the fixed longitudinal wall, the first distance being adjustable by adjusting means for adjusting the first distance, to allow a product of variable size partially wrapped in wrapping sheet to be moved perpendicularly to the axis and inserted between the fixed and adjustable longitudinal walls;

two transverse walls located between the fixed and adjustable longitudinal walls, the transverse walls configured to cooperate with ends of the product partially wrapped in wrapping sheet, the two transverse walls being separated by an adjustable second distance, at least one of the transverse walls being connected to means for adjusting the second distance, wherein the means for adjusting the first distance comprises:

first internal threads and a first slide sliding on a first rectilinear guide means supported by the table of the carousel, the first rectilinear guide means being parallel to a movement of the adjustable longitudinal wall during adjustment of the first distance;

a first screw parallel to the first guide means, the first screw cooperating with the first internal threads, the first screw being kinematically connected to corresponding first screws of other seats, via first associated means, causing an action on the first screw of any seat to synchronously and precisely adjust a same width of all seats of the carousel; and wherein the means for adjusting the second distance comprises:

second internal threads and a second slide sliding on a second rectilinear guide means supported by the table of the carousel, the second guide means being parallel to an adjustment movement during adjustment of the second distance parallel to the axis, a second screw parallel to the second guide means, the second screw cooperating with the second internal threads, the second screw being kinematically connected to corresponding second screws of other seats via second associated means, causing an action on the second screw of any seat to synchronously and precisely adjust a same length of all seats of the carousel.

2. The packaging machine according to claim 1, wherein each second screw is placed parallel to and on an inner longitudinal side of each said fixed longitudinal wall of the seat, in a position that does not interfere with a means that, at the right moment, push the product with the wrapping sheet to unload it from the seat for completing packaging steps performed by successive means, each said second screw being supported at one end by a support fastened to the same fixed longitudinal wall and each second screw being provided on this end with a head to which means of clockwise and anticlockwise rotation can be connected, and means for supporting at least one of the two transverse walls are fastened perpendicularly to the second slide each said second screw being rotationally supported at the other end by a bushing, in turn supported by the table of the carousel and the same second screws pass through respective holes of this table, to arrive on a rear face of the carousel where all the ends of said second screws have fitted on them respective identical pinions, which are interconnected by a chain for ensuring that said pinions and associated screws can rotate simultaneously in the same direction and at the same speed, all to ensure that by acting on the head of any of said second screws, it is possible to perform the adjustment of the second distance the seats to adapt them to the different length of the products to be packaged.

3. The packaging machine according to claim 2, wherein one of the two transverse walls of each seat is fixed and does not change its position as the length of the products to be packaged changes, this transverse wall being supported by a support fixed to an outer face of the fixed longitudinal wall of each seat.

4. The packaging machine according to claim 2, wherein one of the two transverse walls of each seat is also supported by a support that can be fitted with a slide sliding on a guide fastened to a bottom of the fixed longitudinal wall of the seat, and an internal thread that cooperates with a differently threaded second segment of each of said second screws can also be associated with said support in order to obtain a self-centering adjustment of the distance between said transverse walls of all the seats from the rotation of these screws.

5. The packaging machine according to claim 2, wherein the adjustable longitudinal wall of each seat is longitudinally supported by a bracket, the first screw being rotationally supported at the ends by a pair of transfer gearboxes with bevel gearing that, with further first screws, are connected to another two transfer gearboxes connected together by a further first screw, these transfer gearboxes, kinematically connecting said four screws for adjusting the adjustable walls of each seat in a loop arrangement, being fixed to the table of the carousel and being adapted to support said bushings that in turn rotationally support an end of said screws for adjusting the distance between the inner transverse walls of the seats, each one of said transfer gearboxes being equipped with means for the simultaneous operation of said screws in the same direction in order to accomplish with these screws, in a precise and centralized manner, the adjustment of the distance of the adjustable longitudinal wall from the fixed opposite wall.

6. The packaging machine according to claim 5, wherein said transfer boxes are placed on an inner side of each bracket that carries the fixed longitudinal wall of each seat and a respective control rod is rotatably and transversely mounted on each bracket that carries the fixed longitudinal wall of each seat, said control rod being aligned with and connected to a drive output of one of said transfer gearboxes and having a head pointing outwards for operation, such that by acting on any head of said control rods simultaneous adjustment of the distance between the movable wall of the seats and the associated fixed longitudinal wall and by the same amount, to adapt the seats based on a size of the products to be packaged.

7. The packaging machine according to claim 6, further comprising means that ensure that the carousel can be configured for loading the product from a first side, with unloading of the packaged product on, or, with the same carousel having its face with the seats always pointing in the same direction in space, ensure that the carousel can be configured for loading the product from a second side and for unloading the packaged product from the first side.

8. The packaging machine according to claim 7, further comprising means for the cyclic rotation of the carousel for making the carousel rotate in the clockwise direction to feed the product from the first side, or in the anticlockwise direction to feed the product from the second side, and the table of the carousel is being provided with threaded holes to carry said pairs of guides and the fixed brackets, with the different layout necessary for feeding the product from the first or second sides, and that the fixed longitudinal walls and the adjustable walls of the seats are configured to be able to rotate 180° about a transverse axis, means are provided for the different assembly required for these longitudinal walls on the associated brackets, the fixed longitudinal walls of the seats being provided with additional threaded holes to support said guide and said support with the different layout and the adjustable bracket also being provided with additional holes to support said body with said internal thread in opposite positions.

9. The packaging machine according to claim 1, wherein the fixed longitudinal wall of each seat is fastened to the table of the carousel by means of an interposition of a respective bracket that is fastened to said table and longitudinally supports said longitudinal wall of the seat.

10. The packaging machine according to claim 2, wherein said successive means that complete the packaging of the partially wrapped product and unload it from a seat of the carousel and that transfer the packaged product to a successive discharge conveyor, which remains at a fixed height, have a base structure that can oscillate one end about a transverse axis and that is connected to raising and lowering means through which the active transfer surface, can be aligned each time with a lower and adjustable longitudinal wall of the seat that is in the unloading step.

* * * * *